US006265047B1

(12) United States Patent
Chapuis et al.

(10) Patent No.: US 6,265,047 B1
(45) **Date of Patent: *Jul. 24, 2001**

(54) COMPOSITE PRODUCTS, METHODS AND APPARATUS

(75) Inventors: Laurent Chapuis, Lausanne (CH); Thomas M. Ainlay, Walnut Creek; Jean-Pierre Baudet, Alameda, both of CA (US); Marc A. Bruegger, Winkel (CH)

(73) Assignee: Tensile Composite Research, Vaduz (LI)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/173,917

(22) Filed: Oct. 16, 1998

(51) Int. Cl.[7] ..... B32B 5/12

(52) U.S. Cl. ..... 428/111; 428/105; 428/107; 428/109; 428/110; 428/113; 428/114

(58) Field of Search ..... 428/105, 107, 428/109, 110, 111, 113, 114

(56) References Cited

U.S. PATENT DOCUMENTS

| | | | |
|---|---|---|---|
| 2,565,219 | 8/1951 | Gardiner et al. . | |
| 3,903,826 | 9/1975 | Andersen . | |
| 3,954,076 | 5/1976 | Fracker . | |
| 4,133,711 | 1/1979 | August et al. | 156/353 |
| 4,444,822 | 4/1984 | Doyle et al. . | |
| 4,499,842 | 2/1985 | Mahr . | |
| 4,554,205 | 11/1985 | Mahr . | |
| 4,590,121 | 5/1986 | Mahr . | |
| 4,593,639 | 6/1986 | Conrad . | |
| 4,624,205 | 11/1986 | Conrad . | |
| 4,679,519 | 7/1987 | Linville . | |
| 4,708,080 | 11/1987 | Conrad . | |
| 4,831,953 | 5/1989 | Conrad . | |
| 4,945,848 | 8/1990 | Linville . | |
| 5,001,003 | 3/1991 | Mahr . | |
| 5,014,755 | 5/1991 | Bompard et al. . | |
| 5,038,700 | 8/1991 | Conrad . | |
| 5,097,783 | 3/1992 | Linville . | |
| 5,097,784 | 3/1992 | Baudet . | |
| 5,172,647 | 12/1992 | Towne . | |
| 5,304,414 | 4/1994 | Bainbridge et al. . | |
| 5,333,568 | 8/1994 | Meldner et al. . | |
| 5,352,311 | 10/1994 | Quigley . | |
| 5,355,820 | 10/1994 | Conrad et al. . | |
| 5,403,641 | 4/1995 | Linville et al. . | |
| 5,470,632 | 11/1995 | Meldner et al. . | |
| 5,643,522 | 7/1997 | Park | 264/313 |
| 6,090,234 | 7/2000 | Barone et al. . | |
| 6,112,689 | 9/2000 | Baudet . | |

FOREIGN PATENT DOCUMENTS

| | | |
|---|---|---|
| 2926-476 | 6/1979 | (DE) . |
| 3119-734 | 5/1981 | (DE) . |
| 0 056 657 A2 | 7/1982 | (EP) . |
| 056 657 | 7/1982 | (EP) . |
| 0 224 729 | 6/1987 | (EP) . |
| 0271215 | 6/1988 | (EP) . |
| 0 281 322 | 9/1988 | (EP) . |
| 0475083 | 3/1992 | (EP) . |
| 2016368 | 9/1979 | (GB) . |
| 2280516 | 2/1995 | (GB) . |
| 87/07233 | 12/1987 | (WO) . |
| WO 94/11185 | 5/1994 | (WO) . |
| WO 96/07532 | 3/1996 | (WO) . |

OTHER PUBLICATIONS

"Sailcloth the power in the rig," *Yachts and Yachting*, pp. 33–39 (Apr. 12, 1991).

"Sailcloth the power in the rig", *Yachts and Yachting*, Apr. 12, 1991, pp. 33–39, XP002082777.

Y. Termonia, "Structure–Property Relationships in Short–Fiber–Reinforced Resins," *ANTEC '93*, pp. 296–297, (1993).

J.L. Kardos, "Short–Fiber–Reinforced Polymeric composites, Structure–Property Relations," pp. 130–135, (No Date).

"Consolidation Mechanisms and Interfacial Phenomena in Thermoplastic Powder Impregnated Composites," Section 2.2.1. Tow spreading unit, four pages, (No Date).

Catalog No. 5, Tools and Hardware for Manufacturing Composite Parts and Laminates of All Types, Torr Technologies, Inc., Auburn, Washington, (No Date).

*Primary Examiner*—Elizabeth M. Cole
*Assistant Examiner*—Ula C. Ruddock
(74) *Attorney, Agent, or Firm*—James F. Hann; Haynes & Beffel LLP

(57) ABSTRACT

A low-stretch, flexible composite, made of one or several sections, particularly useful for making a sail (2), includes first and second polymer films (52, 62) with discontinuous, stretch-resistant segments (16) therebetween. The segments extend generally along the load lines (17) for the sail. The segments have lengths which are substantially shorter than corresponding lengths of the load lines within each section. The ends of the segments are laterally staggered relative to one another. Mats (20) of generally parallel mat elements can be used as the segments. The mat elements typically include discrete multifiber yarns (24, 26) and/or a fiber array (22), typically created by pneumatically laterally spreading apart the fibers of an untwisted multifiber yarn (32). A laminating assembly includes first and second flexible pressure sheets (66, 68), defining a sealable lamination interior (82) containing the material stack (64) to be laminated, housed within an enclosure (90). A partial vacuum is created within the lamination interior and heated fluid is circulated in contact with the pressure sheets to quickly and uniformly heat the pressure sheets and the material stack being laminated.

40 Claims, 9 Drawing Sheets

COMPOSITE PRODUCTS, METHODS AND APPARATUS

BACKGROUND OF THE INVENTION

The present invention is directed to composite products, methods for their manufacture and apparatus used in their manufacture. The composites are particularly useful for making a sailcraft sail.

Sails can be flat, two-dimensional sails or three-dimensional sails. Most typically, three-dimensional sails are made by broadseaming a number of panels. The panels, each being a finished piece of sailcloth, are cut along a curve and assembled to other panels to create the three-dimensional aspect for the sail. The panels typically have a quadrilateral or triangular shape with a maximum width being limited traditionally by the width of the roll of finished sailcloth from which they are being cut. Typically the widths of the sailcloth rolls range between about 91.5 and 137 centimeters (36 and 58 inches).

Sail makers have many restraints and conditions placed on them. In addition to building products which will resist deterioration from weather and chafe abuses, a goal of modern sailmaking is to create a lightweight, flexible, three-dimensional air foil that will maintain its desired aerodynamic shape through a chosen wind range. A key factor in achieving this goal is stretch control of the airfoil. Stretch is to be avoided for two main reasons. First, it distorts the sail shape as the wind increases, making the sail deeper and moving the draft aft. This creates undesired drag as well as excessive heeling of the boat. Second, sail stretch wastes precious wind energy that should be transferred to the sailcraft through its rigging.

Over the years, sailmakers have attempted to control stretch and the resulting undesired distortion of the sail in three basic ways.

The first way sailmakers attempted to control sail stretch is by using low-stretch high modulus yarns in the making of the sailcloth. The specific tensile modulus in gr/denier is about 30 for cotton yarns (used in the 1940's), about 100 for Dacron® polyester yarns from DuPont(used in the 1950's to 1970's), about 900 for Kevlar® para-aramid yarns from DuPont (used in 1980's) and about 3000 for carbon yarns (used in 1990's).

The second basic way sailmakers have attempted to control sail stretch has involved better yarn alignment based on better understanding of stress distribution in the finished sail. Lighter and yet lower-stretch sails have been made by optimizing sailcloth weight and strength and working on yarn alignment to match more accurately the encountered stress intensities and their directions. The efforts have included both fill-oriented and warp-oriented sailcloths and individual yarns sandwiched between two films. With better understanding of the stress distribution, sailmaking has evolved towards more sophisticated panel-layout constructions. Up until the late 1970's, sails were principally made out of narrow panels of fill-oriented woven sailcloth arranged in cross-cut construction where the majority of the loads were crossing the seams and the width of the narrow panels. With the appearance of high-performance yarn material, like Kevlar, stretch of the numerous horizontal seams in the sails became a problem. To solve this and to better match the yarn alignment with the load patterns, an approach since the early 1980's has been to arrange and seam narrow panels of warp-oriented sailcloths in panel-layout constructions known as "Leech-cut" and later more successfully in the "Tri-radial" construction. The "Tri-radial" construction is typically broken into several sections made from narrow pre-assembled radiating panels. The highly loaded sections of the sail such as the Clew, the Head and the Leech sections are typically made with radial panels cut from heavy sailcloth. The less loaded sail sections, such as the Luff and the Tack sections, are made with panels cut from lighter sailcloth. This approach, unfortunately, has its own drawbacks. Large sails made this way can have up to, for example, 120 narrow panels which must be cut and broadseamed to each other with great precision to form the several large sections. These large sections of pre-assembled panels are then joined together to form the sail. This is extremely time-consuming, and thus expensive, and any lack of precision often results in sail-shape irregularities. The mix of types of sailcloths used causes the different panels to shrink at different rates affecting the smoothness of the sail along the joining seams of the different sections, especially over time.

An approach to control sail-stretch has been to build a more traditional sail out of conventional woven fill-oriented sailcloth panels and to reinforce it externally by applying flat tapes on top of the panels following the anticipated load lines. See U.S. Pat. No. 4,593,639. While this approach is relatively inexpensive, it has its own drawbacks. The reinforcing tapes can shrink faster than the sailcloth between the tapes resulting in severe shape irregularities. The unsupported sailcloth between the tapes often bulges, affecting the design of the airfoil.

A further approach has been to manufacture narrow cross-cut panels of sailcloth having individual laid-up yarns following the load lines. The individual yarns are sandwiched between two films and are continuous within each panel. See U.S. Pat. No. 4,708,080 to Conrad. Because the individual radiating yarns are continuous within each panel, there is a fixed relationship between yarn trajectories and the yarn densities achieved. This makes it difficult to optimize yarn densities within each panel. Due to the limited width of the panels, the problem of having a large number of horizontal seams is inherent to this cross-cut approach. The narrow cross-cut panels of sailcloth made from individual spaced-apart radiating yarns are difficult to seam successfully; the stitching does not hold on the individual yarns. Even when the seams are secured together by adhesive to minimize the stitching, the proximity of horizontal seams to the highly loaded corners can be a source of seam, and thus sail, failure.

A still further approach has been to manufacture simultaneously the sailcloth and the sail in one piece on a convex mold using uninterrupted load-bearing yarns laminated between two films, the yarns following the anticipated load lines. See U.S. Pat. No. 5,097,784 to Baudet. While providing very light and low-stretch sails, this method has its own technical and economic drawbacks. The uninterrupted nature of every yarn makes it difficult to optimize yarn densities, especially at the sail corners. Also, the specialized nature of the equipment needed for each individual sail makes this a somewhat capital-intensive and thus expensive way to manufacture sails.

The third basic way sailmakers have controlled stretch and maintained proper sail shape has been to reduce the crimp or geometrical stretch of the yarn used in the sailcloths. Crimp is usually considered to be due to a serpentine path taken by a yarn in the sailcloth. In a weave, for instance, the fill and warp yarns are going up and down around each other. This prevents them from being straight and thus from initially fully resisting stretching. When the woven sailcloth is loaded, the yarns tend to straighten before they can begin resist stretching based on their tensile strength and resistance to elongation. Crimp therefore delays and reduces the stretch resistance of the yarns at the time of the loading of the sailcloth.

In an effort to eliminate the problems of this "weave-crimp", much work has been done to depart from using woven sailcloths. In most cases, woven sailcloths have been replaced by composite sailcloths, typically made up from individual laid-up (non-woven) load-bearing yarns sandwiched between two films of Mylar® polyester film from DuPont or some other suitable film. There are a number of patents in this area, such as Sparkman EP 0 224 729, Linville U.S. Pat. No. 4,679,519, Conrad U.S. Pat. No. 4,708,080, Linville U.S. Pat. No. 4,945,848, Baudet U.S. Pat. No. 5,097,784, Meldner U.S. Pat. No. 5,333,568, and Linville U.S. Pat. No. 5,403,641.

Crimp, however, is not limited to woven sailcloth and can occur with laid-up constructions also. Crimp in sailcloth made of laid-up yarn can be created in several different ways. First, lateral shrinkage of the films during many conventional lamination processes induces crimp into the yarns. For example, with narrow crosscut panel construction, where a majority of load-bearing yarns are crossing the panel widths, significant crimp of these yarns is induced during lamination of the sailcloth between high-pressure heated rolls. This is because the heated film shrinks laterally as it undergoes thermoforming, typically about 2.5% with this lamination method. The result is catastrophic with regard to the stretch performance for the composite fabric in highly loaded applications.

Second, uninterrupted load-bearing yarns within a sail follow curved trajectories. The yarns used are typically multifiber yarns. Twist is generally added so that the fibers work together and resist stretch along the curved trajectories. If no twist were added, only a few fibers would be submitted to the loads, that is the ones on the outside of the curve. This would substantially limit the ability of the sail to resist stretch. While the tiny yarn spirals created using the twisted multi-fiber yarns help increase load sharing amongst the fibers and therefore reduce stretch, there is still crimp induced as the spiraled yarns straighten under the loads. The twist in the yarns is therefore a necessary compromise for this design, preventing however this type of sailcloth from obtaining the maximum possible modulus from the yarns used.

The various approaches shown in Linville's patents are other attempts to reduce crimp problems. Layers of continuous parallel spaced-apart laid-up yarns are used to reinforce laminated sailcloth. However, because the continuous spaced-apart yarns are parallel to each other, only a small number of them are aligned with the loads. Panels cut out of these sailcloths therefore have poor shear resistance. In addition, no change of yarn density is achieved along the yarns direction. Therefore the proposed designs do not offer constant strain qualities. In addition, these approaches are designed to be used with panel-layout like the Cross-cut, Leech-cut and Tri-radial constructions, which result in their own sets of drawbacks.

The sailcloth shown in Meldner's patent may, in theory, reduce crimp problems. However, it is designed to be used in Tri-radial construction, which results in its own set of problems. Meldner laminates between two films continuous layers of unidirectional unitapes made from side-by-side pull-truded tows of filaments with diameters five times less than conventional yarns. The continuous unidirectional layers are crossing-over each other to increase filament-over-filament cross-over density, which is believed to minimize crimp problems and increase shear strength. Meldner is limited to the use of very small high performance yarns, which are expensive. The cost of those yarns affects greatly the economics of this approach and limits it to "Grand Prix" racing applications. In addition, this design of sailcloth is not intended to offer constant strain qualities; rather stretch and strength resistance are designed to be the same throughout the entire roll length of the sailcloth. Only a small number of the continuous unidirectional filaments end up aligned with the loads.

SUMMARY OF THE INVENTION

The present invention is directed to a low-stretch, flexible composite suited for use in sailmaking. The composite sheet includes one or more sections with a first layer of material, typically a polymer film. At least one of the sections has expected load lines extending over the section. Each section includes a first layer of material and short discontinuous, stretch-resistant segments adhering to the first layer of material and extending generally along the expected load lines. A majority of the segments have lengths substantially shorter than corresponding lengths of the expected load lines within each section. The body of a sail made according to the invention can be made to be two-dimensional or three-dimensional. Two-dimensional sails can be made from one section or a number of flat sections seamed together. The three-dimensional sails can be made from using one or more molded sections of the compostie sheet; alternatively several flat sections which are broadseamed together can be used to create a three-dimensional sail. The invention can be used to create a sail having generally constant strain qualities under a desired use condition and to permit low-stretch performance to be optimized by minimizing the crimp, that is geometrical stretch of the yarns.

According to one aspect of the invention a majority of the segments have lengths substantially shorter than corresponding lengths of the expected load lines within each section. According to another aspect of the invention, the segments have segment ends, at least most of the segment ends being laterally staggered relative to one another within the section.

Another aspect of the invention relates to a method for making a composite, the composite to be placed under a load creating expected load lines. The method includes the steps of choosing stretch-resistant segments and arranging the segments on a first layer of material generally along the expected load lines. The segments and the first layer of material are secured together to create a composite. The composite is preferably made by lamination of the segments between first and second layers of material. The method includes two basic aspects. The first is where the choosing step includes selecting lengths of the segments so that at least most of the segments extend only part way along the expected load lines within a section. The second aspect is where the arranging step includes laterally staggering the ends of the segments within the section to reduce weak areas.

A further aspect of the invention relates to use of mats as the segments. The mats have generally parallel mat elements. The mat elements may include, for example, yarns which might be either twisted or untwisted. The mat elements may include single strands of individual fibers. The mat design typically includes transversely-oriented spaced-apart mat segments which both help to geometrically stabilize the mats and help to provide tear strength parallel to the load lines. The mats can be used as a single layer; where extra strength and/or durability is needed, more than one layer of mats can be used. When multiple mat layers are used, it is preferable that the layers be offset so that the edges of underlying and overlying mats are not aligned.

Another aspect of the invention relates to a laminating assembly in which first and second pressure sheets, at least one being flexible, defining a sealable lamination interior containing the material stack to be laminated, is housed within an enclosure. A pressure differential is created between the lamination interior and the exterior of the pressure sheets, typically by creating a partial vacuum within the lamination interior. A fluid circulator circulates heated fluid, typically air, within the enclosure interior so the heated fluid is in effective thermal contact with the pressure sheets to quickly and uniformly heat the pressure sheets and the material stack being laminated.

The first and second pressure sheets are typically generally flat. They can be tubular, such as cylindrical, as well. For example, the first pressure sheet can be in the form of an aluminum tube around which the material stack is wound; the second pressure sheet can be in the form of an outer flexible sleeve surrounding the material stack. This permits a number of these tubular structures to be placed in a much smaller heated enclosure than would be possible if the pressure sheets were flat. If desired, the aluminum (or other preferably heat-conductive material) tube can be surrounded by an inner flexible sleeve with the material stack captured between the inner and outer flexible sleeves.

A still further aspect of the invention relates to a method for laminating a stack of material using the pressure sheets and the enclosure. The heating fluid is circulated within the enclosure to be in effective thermal contact with at least 80%, and more preferably at least about 95%, of each of the pressure sheets for effective heating and thus lamination of the material stack.

The segments can be made from a variety of materials, including thin metallic rods, segments similar to pieces of monofilament fishing line, multifiber yarns, or laterally spread apart fibers created by, for example, pneumatically spreading apart the fibers of untwisted, multifiber yarns. While most of the segments generally follow the typically curving load lines, transversely oriented segments which cross other segments are preferably used to help increase the overall strength of the composite by resisting tearing of the composite along lines parallel to the load lines.

The use of discontinuous stretch-resistant segments, wherein the segments have lengths substantially shorter than the lengths of the expected load lines within the section, permits the density of the segments to generally correspond to the expected loads at that portion of the composite so that the strength of the composite can be optimized, that is not have too many or too few segments at any location. This eliminates many of the problems associated with the use of the continuous, uninterrupted yarns encountered in the prior art, where there is a fixed relationship between yarn densities and orientation. Also, by using the relatively short segments, crimp is reduced because the trajectory followed by each of the relatively short segments is effectively straight so that it is not necessary to twist the yarns, which is required when long multifiber yarns follow curved trajectories. Crimp can also be reduced because the segments can be stamped or laid in place rather than rolling them onto a substrate using thread applicator machines as used in the prior art. These factors combine to help reduce crimp in the composite to permit the yarns to exhibit strength close to the theoretical tensile modulus. Finally, lower crimp can be achieved using the lamination assembly made according to the invention because the composite can be placed between high friction, flexible pressure sheets. The stack of material preferably has no significant lateral freedom of movement once pressure has been applied so that during heating and lamination, shrinking is substantially prevented. This is in contrast with the approximately 2.5% lateral shrinkage which typically occurs during conventional lamination of fill oriented yarns between, for example, two polyester films using two heated rollers.

The invention allows the designer more flexibility when creating stretch-resisting composites than when using continuous load-bearing yarns. Using continuous load-bearing yarns, constant strain composites, useful for sails or other purposes, cannot be achieved. A compromise must be made either with yarn density or yarn alignment, and generally with both. The compromise typically results in a product made with continuous yarns having too much yarn thickness in the corners while compromising yarn orientation and densities towards the middle of the sail resulting in not enough strength in the mid-leech. Because the present invention is not limited to a fixed relationship between densities and orientations like some of the prior art methods, the present invention provides the flexibility to engineer special effects between segment densities and segment orientations. This is an important improvement over the prior art.

Another advantage results from the invention using mat-type segments in which the mats have transversely-oriented mat elements; doing so permits seams to be made easier because stitching used to join the edges of different sections engage the mat more securely than the stitching would if only individual, radiating, generally parallel segments, typically yarns, were used.

A further advantage of the laminating assembly and method is it requires relatively low capital investment. By avoiding the extensive use of high-capital investment computerized machinery, capital investment may be able to be reduced to, for example, one-third of the capital investment necessary with other composite sailmaking approaches.

The invention permits enhanced quality control over systems used in the prior art. The lamination apparatus and method permits very quick and repeatable cycles because the entire laminate is subjected to uniform and controllable pressures and temperatures. This permits a large area of the composite to be laminated simultaneously. Therefore, the entire stack of material, which is formed into the composite, is subjected to heat and pressure for, for example, one hour, as opposed to only a few seconds between heated rollers or infrared lamps using conventional lamination techniques.

Other features and advantages of the invention will appear from the following description in which the preferred embodiments have been set forth in detail in conjunction with the accompanying drawings.

DESCRIPTION OF THE PREFERRED EMBODIMENTS

Figure 1A:
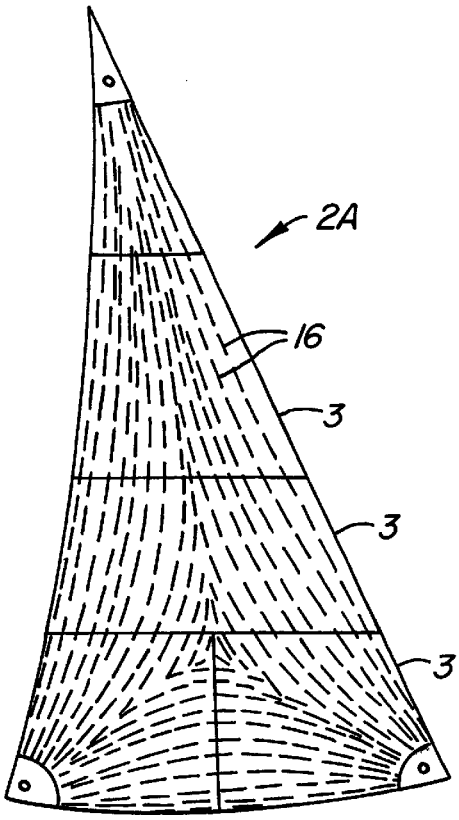
FIG. 1A is a view of a multiple section sail similar to the sail of FIG. 1 where segments shorter than the expected load lines within each section.
Figure 1:
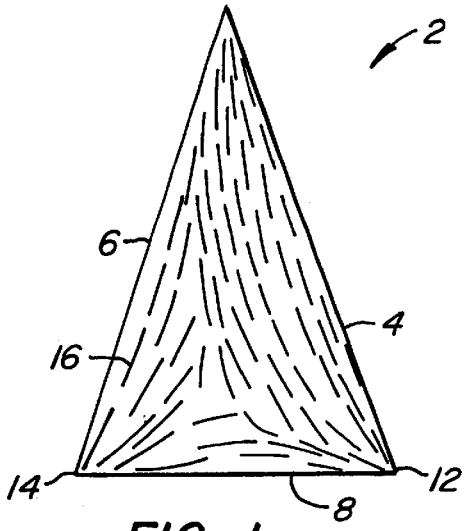
FIG. 1 is a simplified, overall view of a single section sail in which discontinuous, stretch-resistant segments, extending along expected load lines, are laminated between first and second layers of material.

FIG. 1 illustrates a single section sail 2 made according to the invention. In this embodiment the sail has three edges, luff 4, leech 6, and foot 8. Sail 2 also includes three corners, head 10 at the top, tack 12 at the lower forward corner of the sail at the intersection of luff 4 and foot 8, and clew 14 at the lower aft corner of the sail at the intersection of the leech and foot. It will be assumed for the purposes of this discussion that sail 2 is a two-dimensional, flat sail; it could also be a three-dimensional sail. Also, sail 2 is made from a single section. Instead of a single section, the sail could include multiple sections 3, such as in multiple-section sail 2A as shown in FIG. 1A.

Sail 2 includes literally thousands of discontinuous, stretch-resistant segments 16. Only a representative sample of segments 16 are shown in FIGS. 1 and 1A for clarity of illustration. Each segment 16 is preferably generally straight. Segments 16 extend along expected load lines 17 (see FIG. 2) within each section with lengths substantially shorter than the section. That is, when in use under particular loading conditions, the sail will be placed under load along typically arcuate paths. These expected load lines 17, which correspond to particular loading conditions, can be determined empirically using suitable structural analysis software, such as the Relax software from Peter Heppel of England. Expected load lines can also be determined by careful observations during use. Segments 16 are preferably oriented within 6° of, and more preferably within 3° of, load lines 17. Some segments 16 may cross one another to enhance the tear strength of sail 2.

Figure 2:
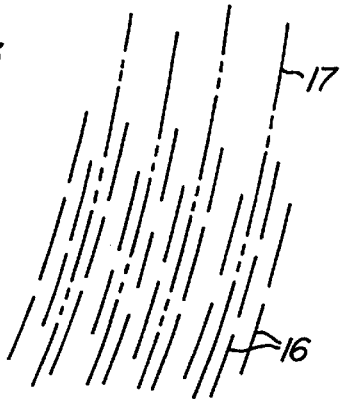
FIG. 2 is an enlarged view illustrating how the discontinuous, stretch-resistant segments extend along expected load lines and are laterally staggered as is desired.

FIG. 2 is an enlarged view of a portion of sail 2 illustrating the laterally staggered nature of segments 16. That is, the ends of each individual segment 16 is laterally offset relative to the adjacent segments. The lateral staggering of segments 16 substantially increases resistance to tearing along lines perpendicular to the load lines in the FIG. 2 embodiment. Tearing generally parallel to the load lines can be inhibited by the use of spaced apart, transversely placed segments, also called cross segments. These are not shown in FIGS. 1–3 for clarity of illustration but are discussed below.

Figure 2A:
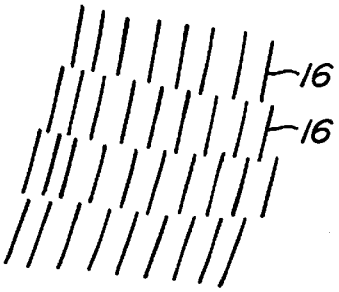
FIG. 2A illustrates lateral alignment of discontinuous segments, an arrangement not in accordance with the present invention.

FIG. 2A illustrates an improper lateral ordering of segments 16. In the embodiment of FIG. 2A, segments 16 are laterally aligned, not laterally staggered as in the embodiment of FIG. 2. The lateral alignment of segments 16 of FIG. 2A is not favored because of the resulting loss in tear or breaking strength perpendicular to load lines 17. There may be, however, some situations in which all or part of sail 2 uses laterally aligned segments 16 as in FIG. 2A.

Segments 16 can be made from a variety of materials including lengths of monofilament material similar to monofilament fishing line, multifiber yarn segments such as carbon fiber segments and yarns made of aramid or polyester, or of fibers sold under the trademarks PBO®, Pentex® or Spectra®. Multifiber carbon yarn segments may be in the form of flattened segments while yarns are often generally cylindrical in shape. Because the segments are relatively short, it is not necessary that the fibers of a multifiber yarn be twisted, thus eliminating a potential source of crimp.

Figure 3:
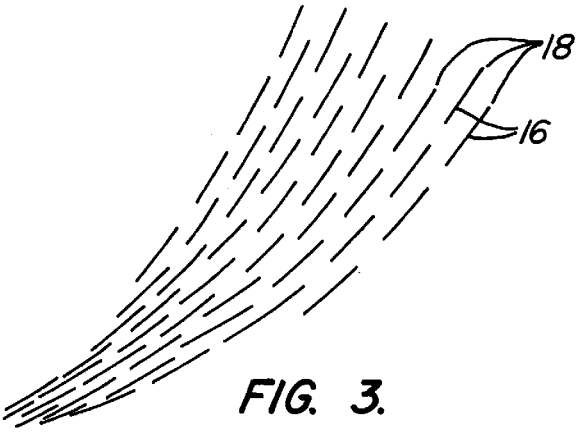
FIG. 3 is an enlarged view illustrating a group of the segments of FIG. 1 extending along curved load lines narrowing towards a corner, the load lines following the directions of the stresses expected under the desired loading of the sail of FIG. 1.

FIG. 3 suggests how as the load lines merge towards a corner of sail 2, not all of what could be considered rows 18 of segments 16 need be continued. This eliminates the excessive yarn buildup at the corners exhibited by some conventional sails which use continuous yarns extending along the entire load line from one edge of the sail (or panel) to another. With the present invention the designer has the ability to provide as many fibers in high-stressed areas, such as at the corners, as is needed.

Figure 4:
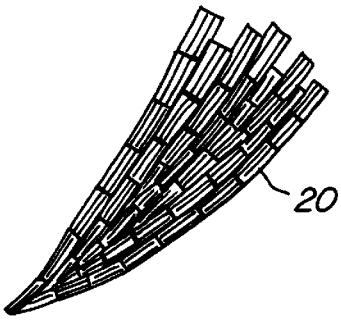
FIG. 4 illustrates replacement of the individual segments of FIG. 3 with mat-type segments, the mat-type segments also following the expected load lines and being laterally staggered as well as longitudinally overlapping.

FIG. 4 illustrates the use of mat-type segments 20, typically termed mats 20, in lieu of the single strand segments 16 shown in FIGS. 1-3. While in certain circumstances individual strands could be properly oriented and laminated between sheets of material to create sail 2, for practical purposes mat-type segments 20 will generally be preferred. Each mat 20 includes generally parallel mat elements which are oriented generally along the load lines. FIG. 4E illustrates a single-section sail 2B including mat-type segments 20.

Figure 4A:
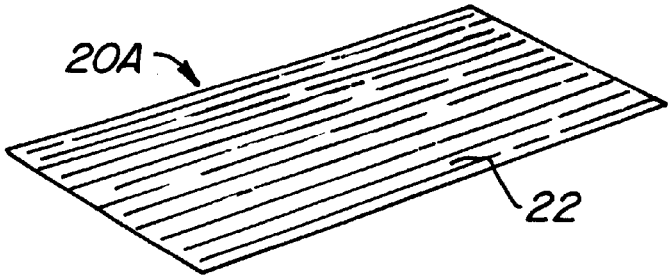
FIG. 4A is an enlarged view of a single mat-type segment of FIG. 4 made of a generally parallel-fiber array, the fiber array geometrically stabilized with an adhesive layer.
Figure 4B:
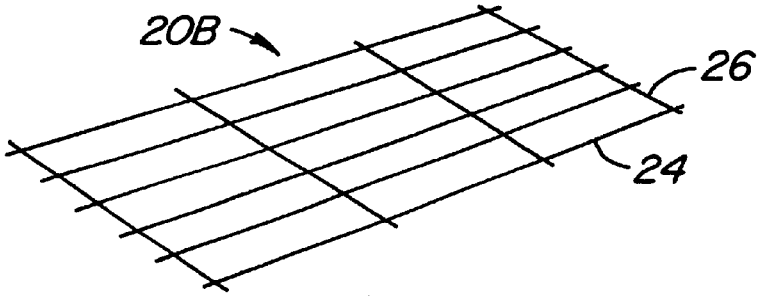
FIG. 4B is an enlarged view of a single mat-type segment of FIG. 4 made of discrete, parallel, spaced-apart yarns and transverse yarns.
Figure 4C:
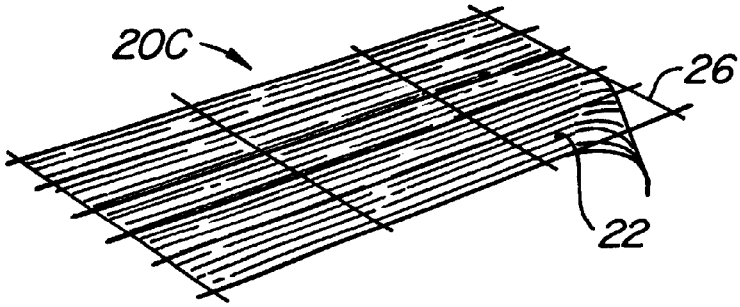
FIG. 4C is a mat-type segment incorporating the fiber array of FIG. 4A and the discrete, parallel, spaced apart transverse yarns of FIG. 4B.

FIGS. 4A, 4B and 4C illustrate three basic types of mats. Mat 20A is made of a parallel fiber array 22 in which the fibers are spread apart, but touching. The fibers of fiber array 22 may be a single fiber deep, multiple fibers deep or a mixture. The fibers of fiber array 22 are generally parallel fibers with some of the fibers crossing over. Fiber array 22 is mounted to an adhesive layer to maintain the physical integrity of mat 20A. Mat 20A is the type of mat which can be made using the apparatus described below with reference to FIG. 5. FIG. 4B illustrates a mat 20B made of discrete load-bearing yarns 24 and discrete transverse yarns 26 bonded or otherwise secured to discrete yarns 24 both to maintain the parallel arrangement of yarns 24 and to permit mat 20B to be moved, handled and manipulated. Mat 20B can be made using, for example, the apparatus described below with reference to FIG. 6. Mat 20B is used with yarns 24 generally parallel to load lines 17. FIG. 4C illustrates a mat 20C which is somewhat of a combination of mats 20A and 20B. Mat 20C includes a fiber array 22 plus discrete transverse yarns 26. Transverse yarns 26 provide a dual purpose of helping to stabilize fiber array 22 and also provide resistance to tearing parallel to load lines 17.

Figure 5A:
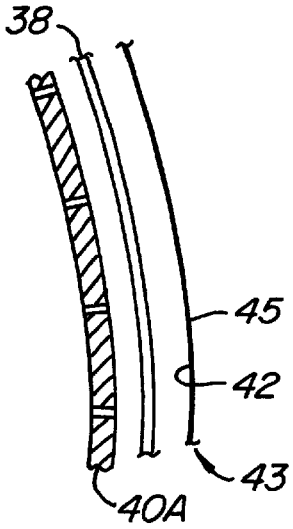
FIG. 5A is an enlarged, exploded, partial cross sectional view of a perforated drum, a layer of fibers and an adhesive layer combination.
Figure 5B:
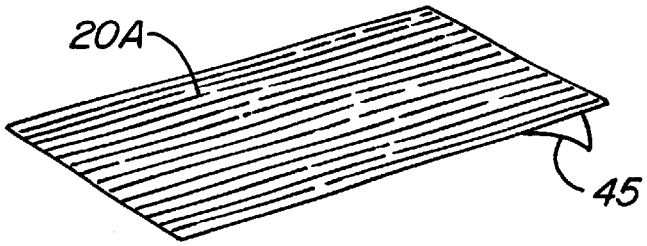
FIG. 5B illustrates a mat made from the structure of FIG. 5A showing the releasable backing of the adhesive layer combination being removed.
Figure 5:
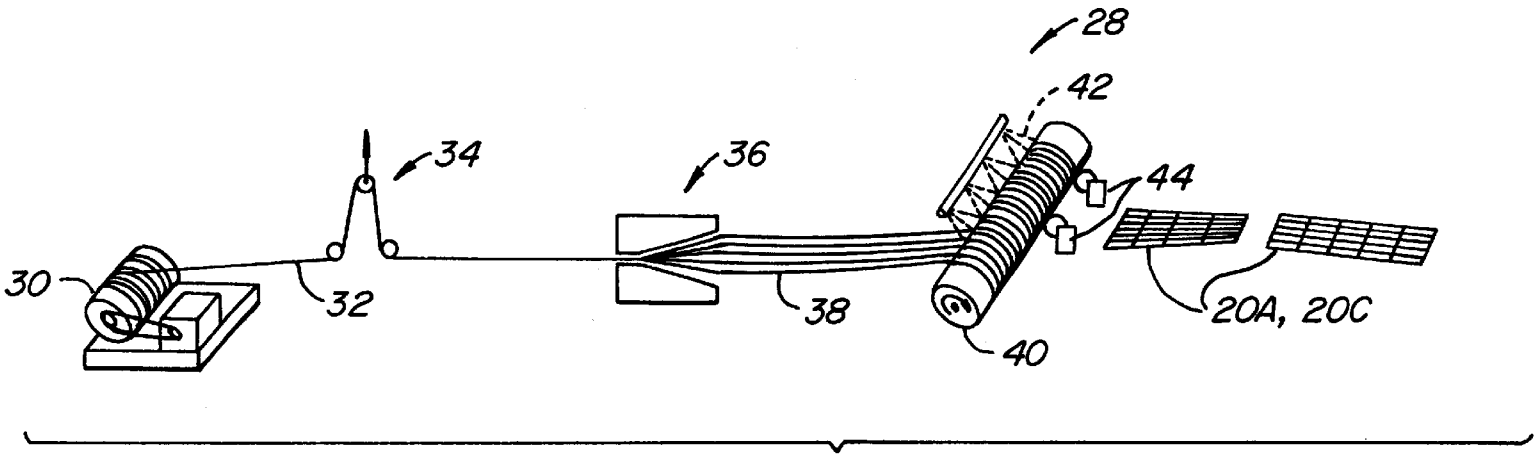
FIG. 5 is a schematic drawing illustrating the making of mats of the laterally oriented, parallel-fiber arrays of FIGS. 4A and 4C.

FIG. 5 illustrates, very schematically, an apparatus 28 used to form mats 20A and 20C of FIGS. 4A and 4C. Apparatus 28 includes broadly a spool 30 from which untwisted, multifiber yarn 32 is taken past a roller tensioning system 34 and through a pneumatic yarn fiber spreader 36. Jets of air are used to spread the multifiber yarn 32 into spread-apart fibers 38. Pneumatically spreading apart the fibers 38 of yarn 32 permits large multifiber yarns to be used. The large multifiber yarns are relatively inexpensive and can be spread apart into a fiber array of a desired density.

Spread-apart fibers 38 are wound onto a large diameter (typically about 30 cm to 1 m diameter) take-up drum 40. If desired to create mats 20C with discrete transverse yarns 26, cross yarns are laid along the outer circumference of drum 40 generally parallel to its axis before or after winding spread-apart fibers 38 onto the drum. An uncured adhesive is then applied to spread-apart fibers 38 on drum 40. Adhesive 42 is illustrated being sprayed onto drum 40. The adhesive could also be applied to drum 40 using an engraved roller or the outer surface of drum 40 could be coated with an adhesive release material and the adhesive applied to the outer surface prior to the winding step. The adhesive or other binding structure helps to maintain the spaced-apart fibers 38 in their spread-apart form to create spread-apart fiber array 22 of mats 20A or 20C. The adhesive also helps to secure discrete transverse yarns 26 to spread-apart fibers 38. After covering drum 40, mats 20A/20C are cut from drum 40 using cutters 44.

Another preferred method involves the use of a perforated drum 40A, an exploded partial cross-section of which is shown in FIG. 5A, in which fibers 38 are wound onto the drum and adhesive 42 is applied as a layer on top of fibers. Adhesive 42 is one layer of an adhesive layer combination 43 with the other layer being a releasable backing 45, typically a flexible paper-like material. By applying a partial vacuum within perforated drum 40A and a moderate amount of heat to combination 43, adhesive 42 bonds to fibers 38 for the production of mats 20A. Mats 20A have releasable backing 45 which helps to prevent contamination of the mat and also adds structural stability to the mat. Backing 45 is removed, see FIG. 5B, when mat 20A is mounted in place as discussed below with reference to FIG. 7.

Figure 6A:
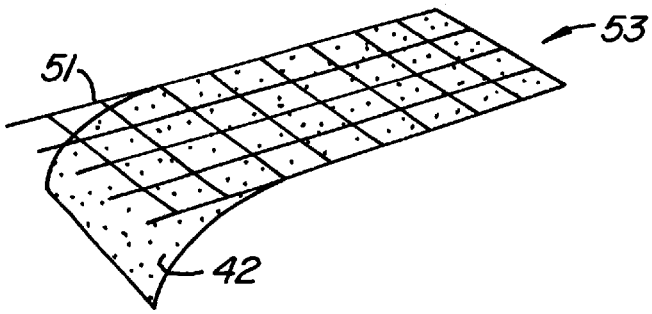
FIG. 6A illustrates an adhesive/scrim film.
Figure 6:
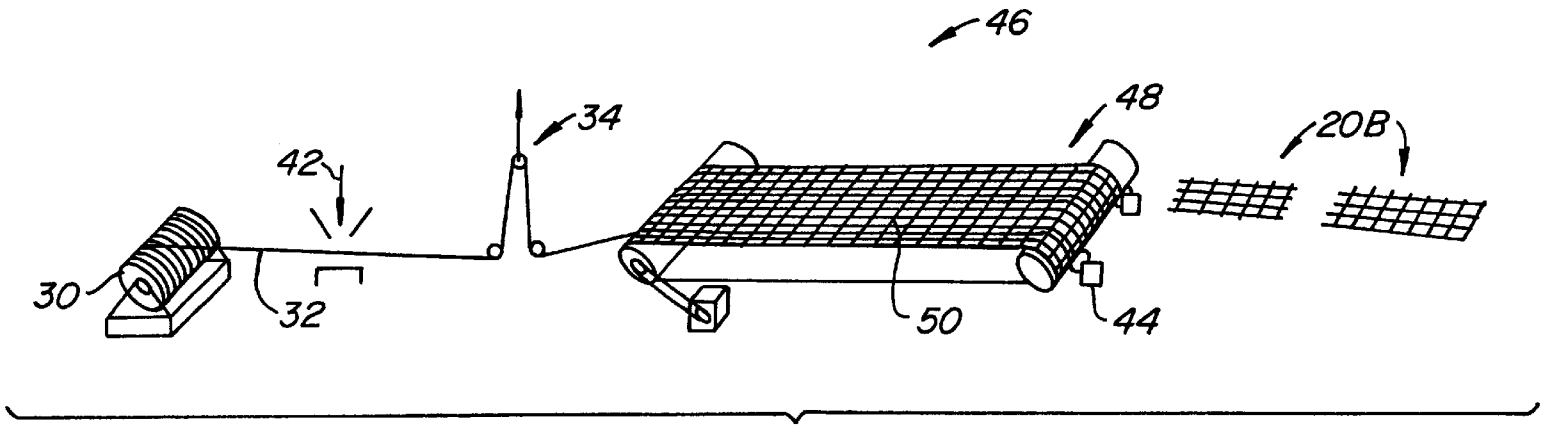
FIG. 6 illustrates schematically the manufacture of the meshwork mat-type segments of FIG. 4B.

FIG. 6 illustrates an apparatus 46, similar to apparatus 28, used to create mat 20B with like reference numerals referring to like elements. Multifiber yarn 32 is unrolled from spool 30 and is coated with an adhesive 42 and wound about a belt carrier system 48. In this embodiment multifiber yarn 32 is not spread apart as in the embodiment of FIG. 5 but rather the yarn itself is would onto system 48 in a spaced-apart manner. The spacing between the yarns 32 are typically about 2 to 20 mm. Before or after winding yarn 32, cross yarns 50, which create the discrete transverse yarns 26 of mat 20B of FIG. 4B, are added to enhance tear resistance. Additional uncured adhesive is then applied to this meshwork filling the gaps between yarns 32. The additional adhesive could be sprayed on or applied with an engraved roller or applied as a wide uncured adhesive web onto the meshwork. In a later step the extra adhesive is used to bond mat 20B between film layers. The additional adhesive between the yarns 32 is not typically necessary to maintain the physical integrity of mat 20B; that is typically achieved by the adhesive bonds created between the crossing yarns 32, 50. After creating the meshwork, the meshwork is cut to create mats 20B.

Figure 4D:
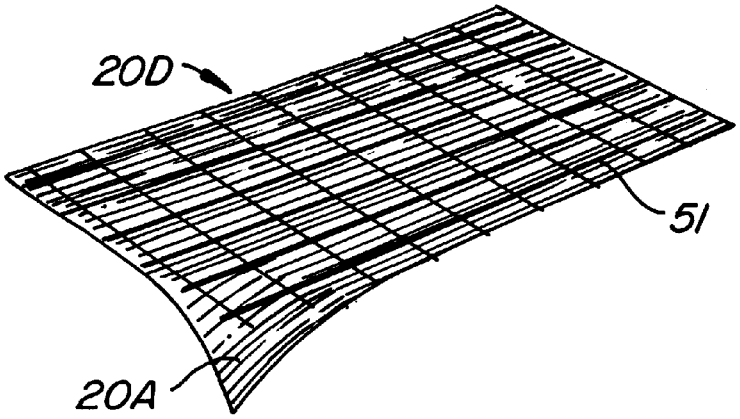
FIG. 4D illustrates the combination of the mat of FIG. 4A with a mesh or scrim used to improve resistance to tearing.
Figure 4E:
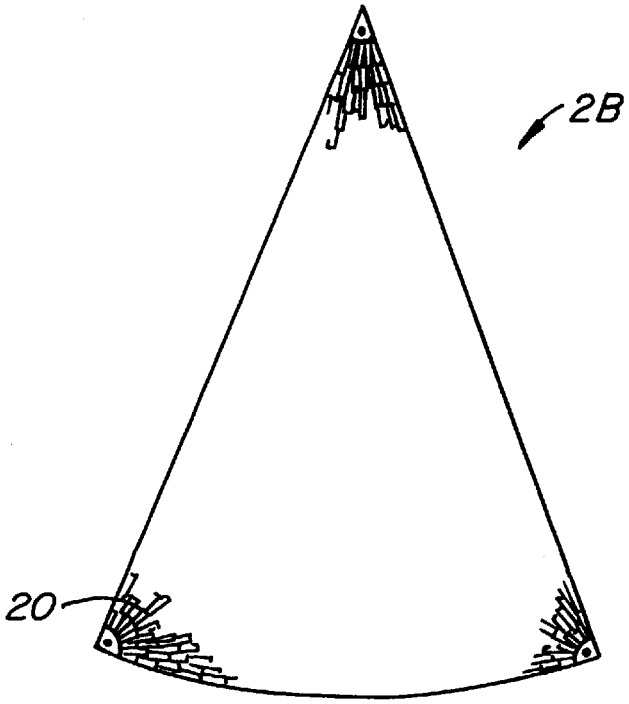
FIG. 4E illustrates a single section sail similar to the sail of FIG. 1 but where the segments are mat-type segments.

Another way to add tear-resistance to the finished product is to use, for example, a commercially-available mesh or scrim 51 in combination with the fiberous mat 20A of FIG. 4A to create mat 20D illustrated in FIG. 4D. Scrim 51 is not used for its tensile strength along load lines 17 but to provide tear resistance, particularly parallel to load lines 17. One example of scrim 51 is a non-woven rectangular grid of yarns made of Kelvar, Spectra or polyester about 200–800 denier and spaced about 5 to 50 mm (0.2 to 2 inches) apart.

The adhesive 42 of adhesive layer combination 43 could be combined with scrim 51 to create an adhesive/scrim layer 53 illustrated in FIG. 6A. Adhesive/scrim layer 53 could be used without releasable backing 45 because scrim 51 provides additional strength and stability to adhesive 42.

Figure 7:
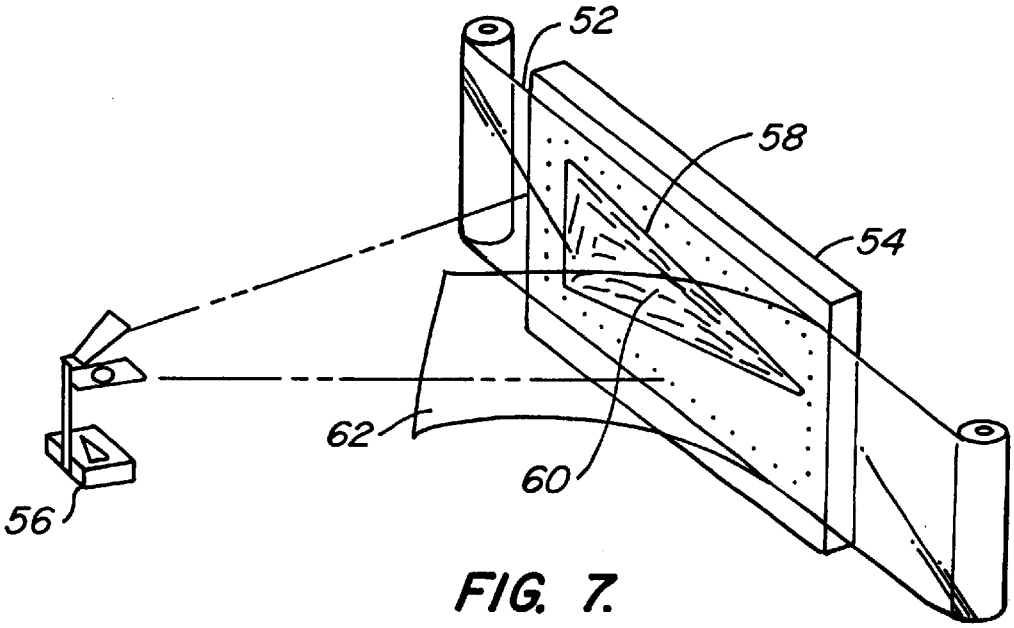
FIG. 7 is a simplified illustration of the projection of the outline of the sail of FIG. 1 including load lines and/or segment/mat placement lines.

Segments, typically mats, are then laid up onto a first film layer 52, see FIG. 7, located against a generally vertically oriented vacuum board 54. First film layer 52 is typically made of PEN or PET about 0.1 to 0.5 mil thick. A light projector 56 projects an outline 58 of sail 2 and segment placement marks 60 onto first film layer 52. Segment placement marks 60, illustrated in FIG. 7, correspond to the positions of individual segments 16 of FIG. 2. Marks corresponding to load lines 17 of FIG. 2 and/or marks corresponding to mats 20 of FIG. 4 could be used in lieu of or in addition to the segment placement marks 60 of FIG. 7. Segments 16 and/or mats 20 can then be adhered to first film layer 52 according to segment placement marks 60. Any releasable backing 45 can now be removed. After this is accomplished, a second film layer 62 is applied on top of the newly placed mats 20 and temporarily sealed to the mats. If desired, this laying up of the mats, or other segments, could be automated using, for example, a multiaxis robot. After sealing second film layer 62 to first film layer 52, the film layers 52 and 62 are then cut along the vertical edges of vacuum board 54 forming a material stack 64.

Figure 8:
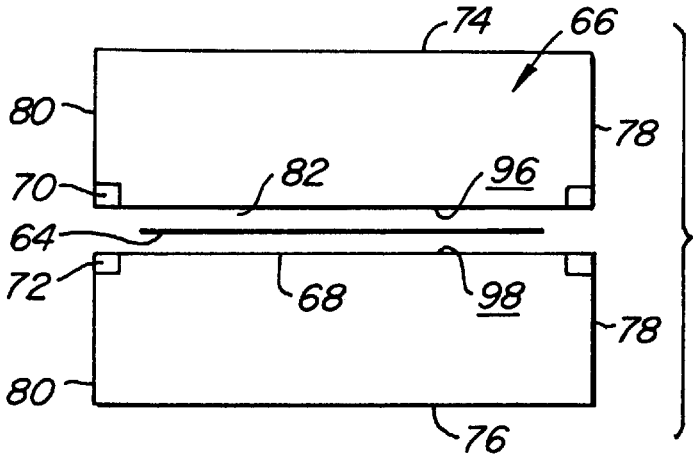
FIG. 8 is a schematic diagram illustrating placement of a stack of material created by the process illustrated in FIG. 7 between high-friction, flexible pressure sheets stretched between frames, the frames carried by upper and lower enclosure members, respectively.
Figure 8A:
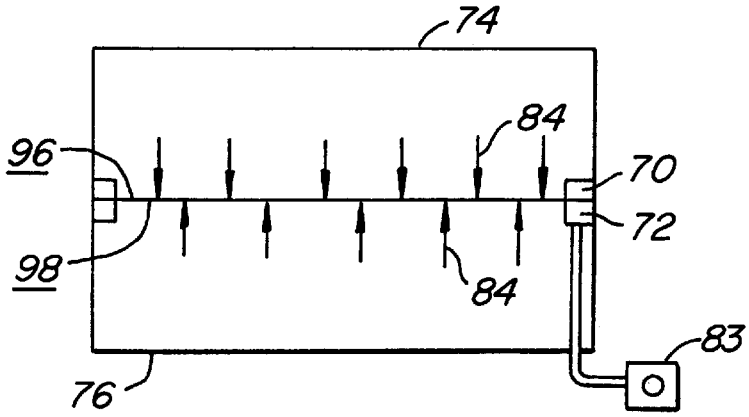
FIG. 8A shows the structure of FIG. 8 after the upper and lower enclosure members have been brought together capturing the stack of material within a lamination interior between the flexible pressure sheets and then application of pressure to the outer surfaces of the flexible pressure sheets by creating a partial vacuum within the lamination interior.
Figure 8B:
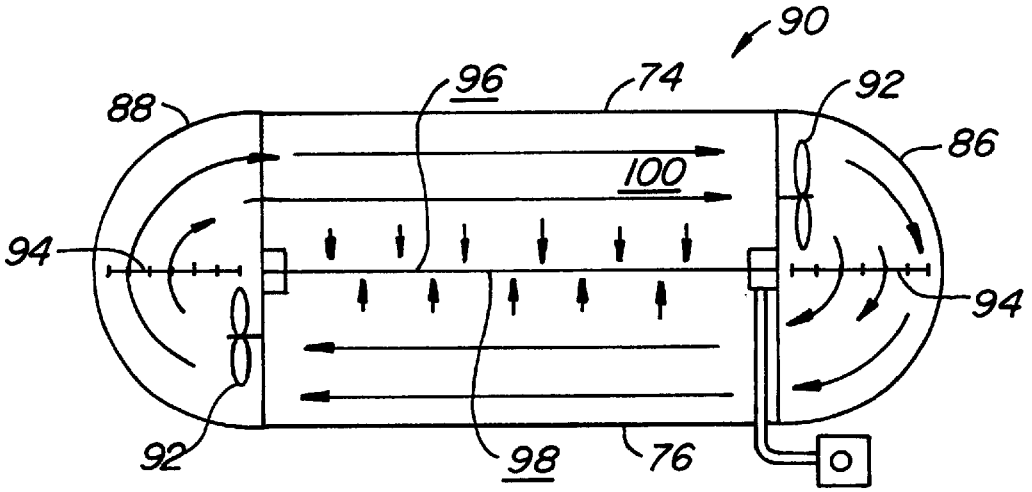
FIG. 8B illustrates placement of first and second end enclosure members adjacent to the open ends of the closed upper and lower enclosure members, the end enclosure members each including a recirculating fan and an electric heater element so to cause heated, circulating fluid to pass by the outer surfaces of the flexible pressure sheets.

Material stack 64 is positioned between upper and lower flexible pressure sheets 66, 68 as shown in FIG. 8. Pressure sheets 66, 68 are preferably made of a flexible, elastomeric material, such as silicone, which provides high-friction surfaces touching first and second film layers 52, 62 of material stack 64. Upper and lower flexible pressure sheets 66, 68 are circumscribed by upper and lower rectangular frames 70, 72. Frames 70, 72 are mounted to upper and lower enclosure members 74, 76. Each enclosure member 74, 76 is a generally three-sided enclosure member with open ends 78, 80. Upper and lower enclosure members 74, 76 carrying frames 70, 72 and flexible pressure sheets 66, 68 therewith, are then brought together as shown in FIG. 8A. A partial vacuum is then created within a lamination interior 82 formed between sheets 66, 68 using vacuum pump 83, thus creating a positive lamination pressure suggested by arrows 84 in FIG. 8A. First and second end enclosure members 86, 88, see FIG. 8B, are then mounted over the open ends 78, 80 of upper and lower enclosure member 74, 76 to create a sealed enclosure 90. First and second end enclosure members 86, 88 each include a fan 92 and an electric heater element 94. Fans 92 cause air or other fluids, such as oil, within enclosure 90 to be circulated around and over the outer surfaces 96, 98 of flexible pressure sheets 66, 68. This ensures that flexible pressure sheets 66, 68 and material stack 64 therebetween are quickly and uniformly heated from both sides. Because the entire outer surfaces 96, 98 can be heated in this way, the entire material stack 64 is heated during the entire lamination process. This helps to ensure proper lamination. The high-friction nature of sheets 66, 68 secures first and second film layers 52, 62 in place and prevents any substantial shrinkage of the film layers during lamination. Any shrinkage which does occur should occur in all directions to minimize any resulting crimp in fiberous segments. After a sufficient heating period, the interior 100 of enclosure 90 can be vented to the atmosphere and cooled with or without the use of fans 92 or additional fans.

The adhesive on mats 20 is preferably used as the lamination adhesive. The amount and type of adhesive affects the strength and durability of the lamination. There is usually needed more adhesive per fiber weight in the high fiber density areas, such as at the corners, than in the low fiber density areas. In areas where more adhesive is used, the adhesive is preferably more flexible than where less adhesive is used. Therefore, mats 20 and other segments 16 which are destined for use at corners and other high-density areas may be coated with a greater amount of more flexible adhesive than segments destined for use at other areas.

Figure 9:
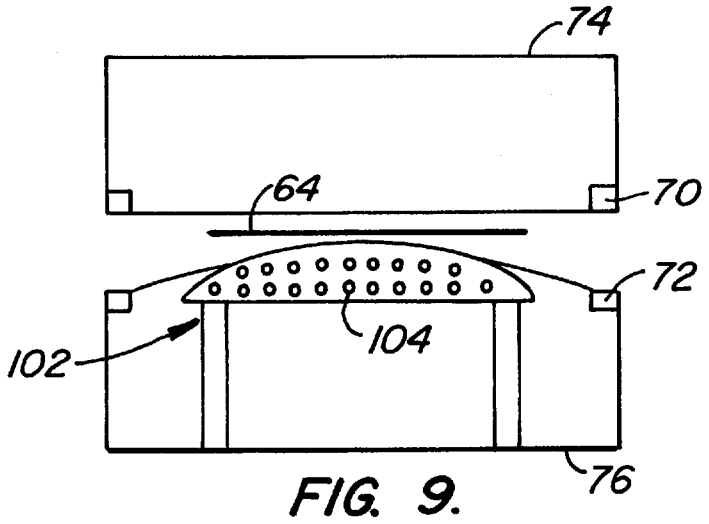
FIG. 9 illustrates an alternative embodiment similar to FIG. 8 but including the use of a perforated form against the outer surface of the lower pressure sheet to create a three-dimensional curvature to the lower pressure sheet opposite the stack of material.
Figure 9A:
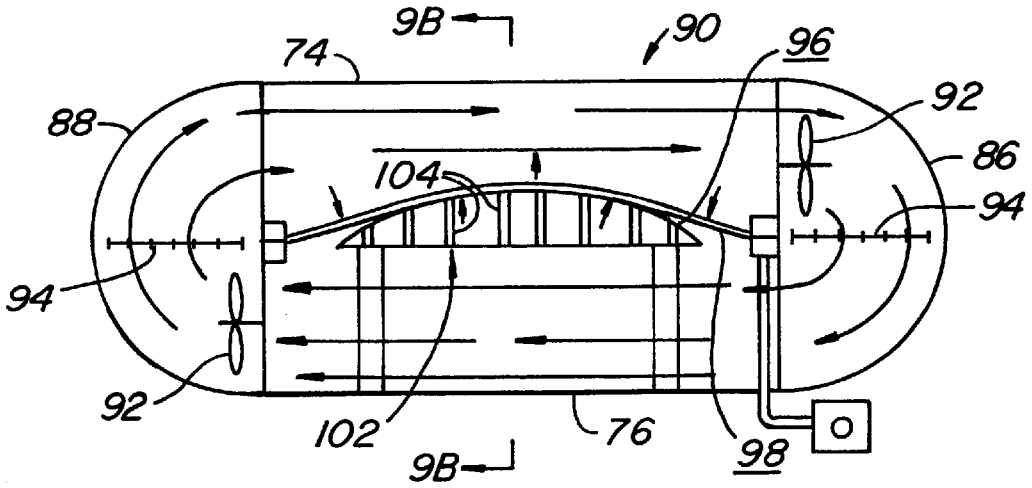
FIG. 9A shows the effect of using the perforated form of FIG. 9 with the apparatus of FIG. 8B, the perforated form permitting free flow of heated air to the outer surface of the lower pressure sheet while causing the lamination to take place to create a three-dimensional composite.
Figure 9B:
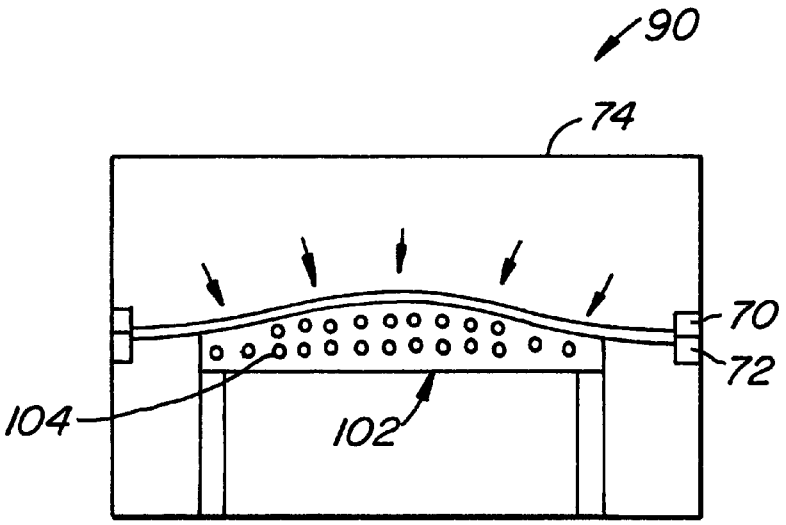
FIG. 9B is a simplified cross-sectional view taken along line 9B–9B of FIG. 9A illustrating the flow channels of the perforated form.

FIGS. 9, 9A and 9B illustrate an alternative embodiment of the invention very similar to the embodiment of FIGS. 8–8B. The primary difference is the use of a perforated form 102 contacting outer surface 98 of lower flexible pressure sheet 68. In the preferred embodiment, perforated form 102 is made up of a number of relatively thin vertically-oriented members 104 oriented parallel to one another with substantial gaps therebetween to permit the relatively free access to the heated fluid to lower surface 98. Preferably, no more than about 20%, and more preferably no more than about 5%, of that portion of lower surface 98 which is coextensive with material stack 64 is covered or effectively obstructed by perforated form 102. Instead of vertically-oriented members 104, perforated form 102 could be made of, for example, honeycomb with vertically-oriented openings. Many dead spaces could be created within the vertically-extending honeycomb channels, thus substantially hindering heat flow to large portions of lower surface 98. This can be remedied by, for example, changing the air flow direction so the air is directed into the honeycomb channels, minimizing the height of the honeycomb, and providing air flow escape channels in the honeycomb near surface 98. Other shapes and configurations for perforated form 102 can also be used.

Preferably the heated fluid within interior 100, which may be a gas or a liquid, is in direct thermal contact with upper and lower surfaces 96, 98. However, in some circumstances an interposing surface could be created between the heated fluid and surfaces 96, 98. So long as such interposing surfaces do not create a significant heat barrier, the heated fluid will remain in effective thermal contact with outer surfaces 96, 98 of pressure sheets 66, 68. That is, it is desired that any reduction in heat transfer be less than the reduction which would occur if about 20% of that portion of lower surface 98 which is coextensive with material stack 64 is thermally insulated from the heating fluid.

Figure 10:
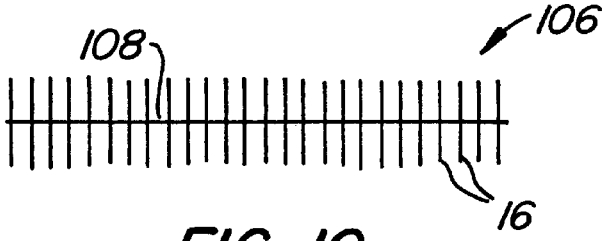
FIG. 10 illustrates a strip or belt of the segments of FIGS. 1 and 2.
Figure 10A:
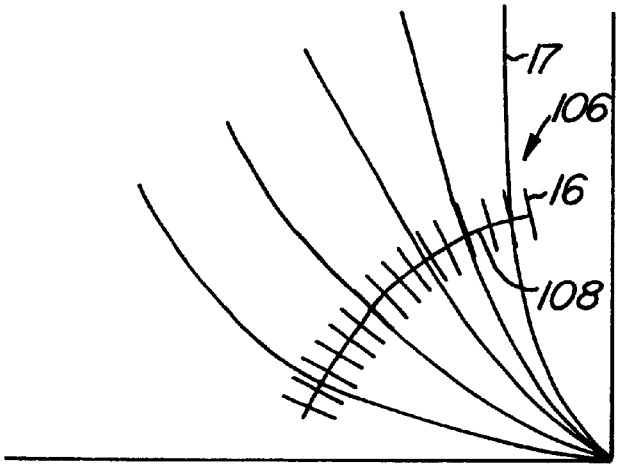
FIG. 10A illustrates the use of the belt of segments of FIG. 10 with the segments properly oriented relative to the load lines.

Segments 16 can be organized in the form of flexible, spine-like belts 106 shown in FIGS. 10 and 10A. Belts 106 include a non-load-bearing central strand 108 which connect segments 16 together. Each segment 16 naturally assumes an orientation 90° to central strand 108. Therefore, by orienting strand 108 90° to load lines 17, segments 16 automatically become generally aligned with the load lines. Belts 106 may be especially useful for automated arrangement of segments 16 along load lines 17.

Segments 16 of belt 106 are shown to be of equal lengths with their ends laterally aligned. Segments 16 can be laterally staggered using belts 106 in several ways. One is to laterally stagger segments 16 in each belt 106; this may entail making segments 16 of different lengths as well. Also, when applied to first film layer 52, adjacent belts 106 of segments 16 can be overlapped with one another to help provide the desired lateral staggering of segments 16.

Figure 11:
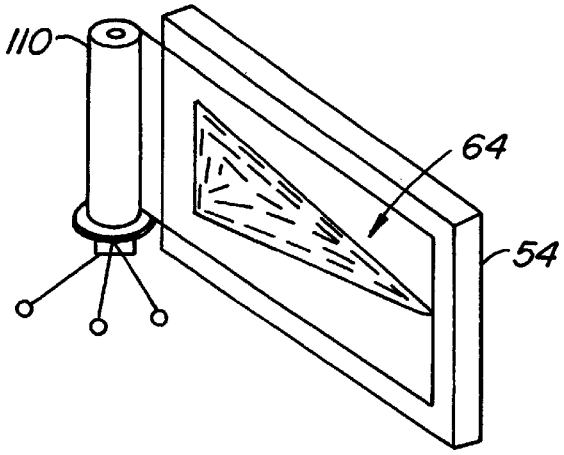
FIG. 11 is a simplified view of an alternative embodiment of the structure of FIG. 7 including a vacuum rewinding drum.
Figure 12:
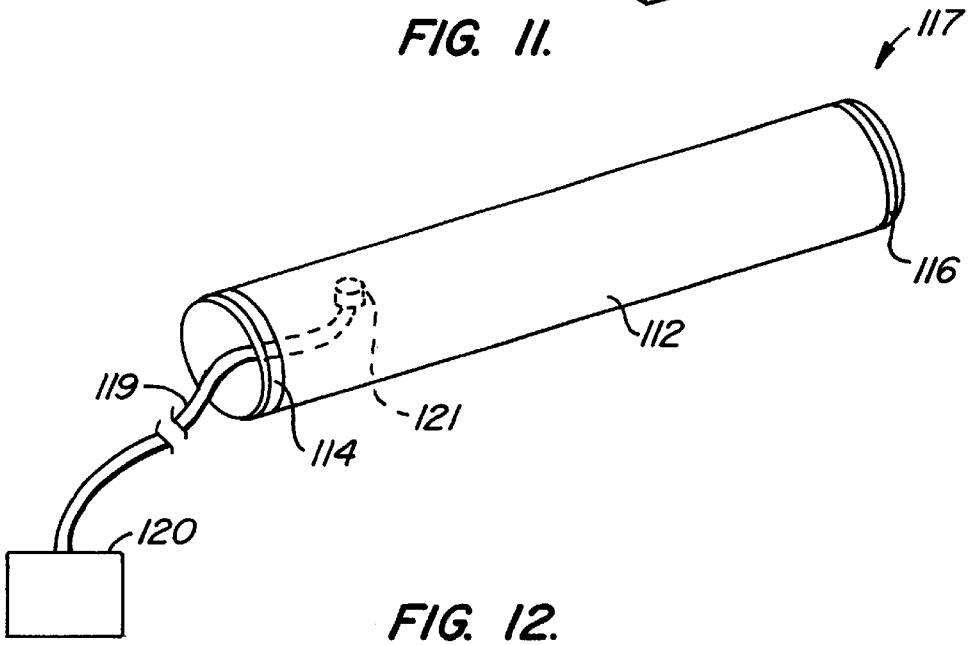
FIG. 12 illustrates the rewinding drum of FIG. 11, with the material stack wound thereon, encased within an elastomeric sleeve to create a lamination cylinder assembly.
Figure 12A:
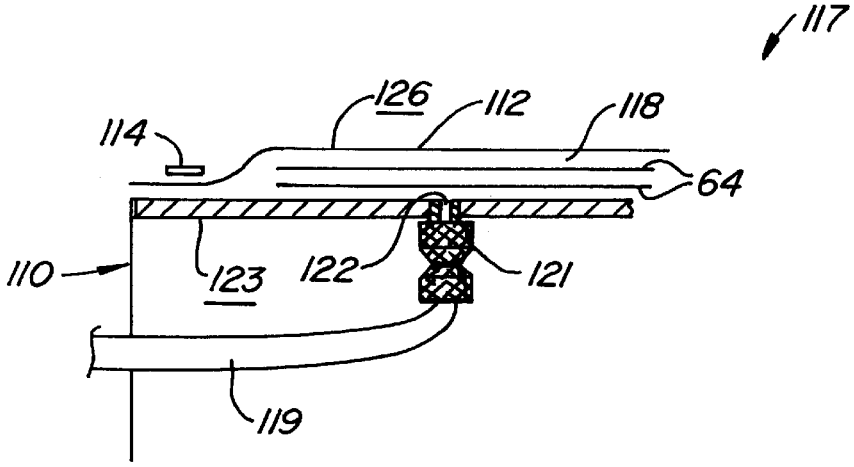
FIG. 12A is an enlarged cross-sectional view of a portion of the end of the lamination cylinder assembly of FIG. 12 with various layers spaced-apart for clarity of illustration.
Figure 13:
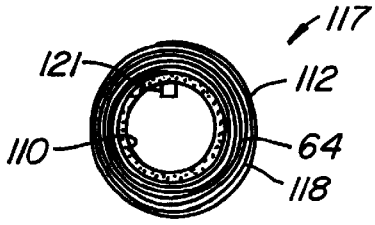
FIG. 13 is a simplified cross-sectional view of the lamination cylinder assembly of FIG. 12 with gaps shown between the various layers for ease of illumination.

A further alternative embodiment of the invention is illustrated in FIGS. 11–13. FIG. 11 is similar to FIG. 7. However, after stack 64 is made, it is wound onto a vacuum rewinding drum 110. While drum 110 is cylindrical, other tubular shapes can also be used for drum 110. The drum is typically about 20 to 40 cm (8 to 16 inches) in diameter by 1.5 to 6 m (5 to 20 feet) in length. The rewinding tension is carefully controlled to achieve a uniform tension throughout. After stack 64 is wound onto drum 110, a flexible, and preferably elastomeric, sleeve 112 is used to encase stack 64 on drum 110. See FIGS. 12 and 12A. Elastic bands 114, 116 are used to seal the ends of drum 110 and sleeve 112 to create a lamination cylinder assemby 117, assembly 117 defining a lamination interior 118. See FIGS. 12A and 13. A vacuum pump 120 is coupled to vacuum port 122 formed in drum 110 by a sealable fitting 121. Operation of vacuum pump 120 creates a partial vacuum within interior 118 to cause sleeve 112 to press against spiral-wound stack 64. After the desired partial vacuum is created, fitting 121 is sealed and the vacuum line 119 is removed from fitting 121.

Figure 14:
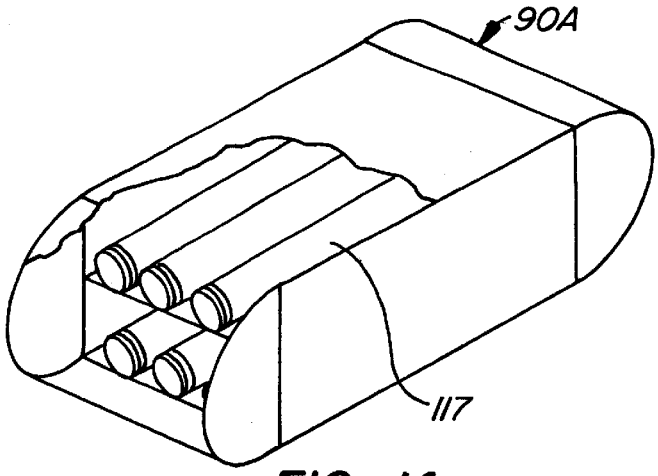
FIG. 14 is a simplified view showing several of the lamination cylinder assemblies of FIG. 12 within a single enclosure.

The purpose of using generally cylindrical pressure sheets (that is drum 110 and sleeve 112) instead of generally planar pressure sheets 66, 68 is to permit several of the lamination cylinder assemblies 117 of FIGS. 12 and 13 to be used in a single heated enclosure 90A as shown in FIG. 14. Thus, enclosure 90A can be made much smaller for the same size composite, such as a sail 2 or a sail section 3, as would be required with the apparatus of FIGS. 8–8B. Like the above-described embodiments, heated fluid has access to both sides of material stack 64 through the inner surface 123 of open-ended drum 110 and to the outer surface 126 of elastomeric sleeve 112.

Figure 15:
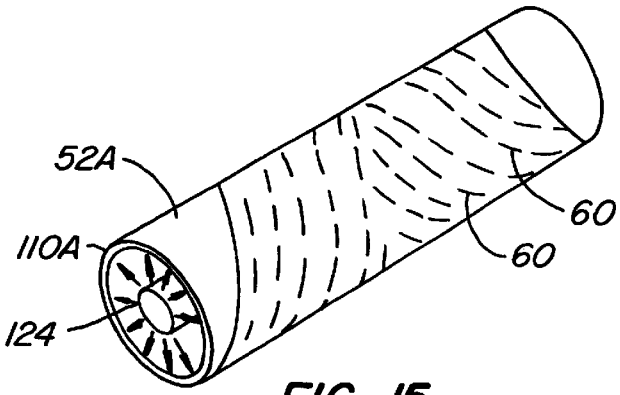
FIGS. 15 and 16 illustrate an alternative to the embodiment of FIGS. 11–14 with FIG. 15 showing a vacuum drum with a first film layer on the outside of the drum and a segment projector inside the drum, and FIG. 16 showing a lamination cylinder assembly similar to that of FIG. 12.
Figure 16:
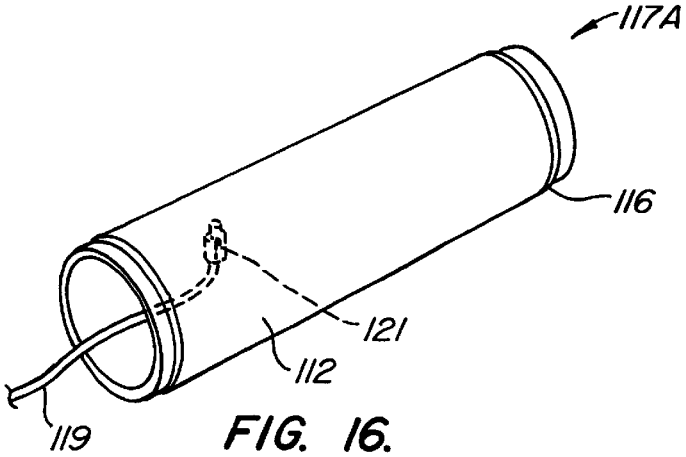

FIGS. 15, 16 illustrate, schematically, an alternative to the apparatus and method of FIGS. 11–14 with like reference numerals referring to like elements. An open-ended vacuum drum 110A houses a segment projector 124 which projects segment placement marks 60 onto a first film layer 52A. Segment projector 124 could project marks 60 through drum 110A if drum 110A is transparent or sufficiently translucent. Segments 16 or mat-type segments 20 are secured to film layer 52A. A second film layer, not shown in FIG. 15, is then wound onto drum 110A to create a material stack (not shown). Elastomeric sleeve 112 is then used to encase the material stack and elastic bands 114, 116 are mounted to the ends of drum 110A to create a lamination cylinder assembly 117A, shown in FIG. 16. Assembly 117A is then processed in a manner similar to that discussed above with reference to FIGS. 12–14.

The embodiment of FIGS. 15, 16 could use external projection of marks 60 as opposed to the internal projection shown. External projection may be preferred when a multiple-layer stack of material, such as is typical with the embodiment of FIGS. 11–14, is created. The embodiment of FIGS. 15, 16 is particularly suited for use with automated segment-placing equipment. Automated equipment may be particularly useful for placement of the segment belts 106 of FIGS. 10, 10A with the embodiment of FIGS. 15, 16. If segments 16, 20 are placed using automated equipment, projecting marks 60 may not be necessary except as a quality control check.

An advantage of the invention is that it substantially reduces the number of panels needed to make a sail. For example, a multiple section sail 2A made according to the invention will typically have five to eight sections; a similar cross-cut sail will have about 35 to 40 panels while a tri-radial sail will have about 120 panels.

Other modifications and variations can be made to the disclosed embodiments without departing from the subject of the invention as defined by the following claims. For example, segment placement marks 60 could also be cut into the circumferential surface of drum 110A; such through-holes permit light to pass through and act as vacuum ports.

Any and all patents, applications and publications referred to above are incorporated by reference.

What is claimed is:

1. A low-stretch, flexible composite comprising:

a sheet of material; and the sheet comprising at least one section having expected load lines extending over the section, each section comprising:

a first layer of material; and a plurality of discontinuous, stretch-resistant segments adhering to the first layer of material and extending generally along the expected load lines, a majority of the segments having lengths substantially shorter than corresponding lengths of the expected load lines within the section.

2. The composite according to claim 1 wherein said section comprises a corner.

3. The composite according to claim 2 wherein a majority of the load lines extend from the corner.

4. The composite according to claim 1 wherein the number and placement of the segments generally correspond to the expected load lines so to help create a constant-strain composite under a chosen loading of the composite.

5. The composite according to claim 1 wherein the sheet has three corners.

6. The composite according to claim 1 wherein the sheet comprises a plurality of the sections.

7. The composite according to claim 1 wherein the sheet comprises only one said section.

8. The composite according to claim 1 wherein the sheet is a generally two-dimensional, flat sheet.

9. The composite according to claim 1 wherein the sheet is a three-dimensional sheet.

10. The composite according to claim 1 wherein the sheet comprises a second layer of material adhered to the first layer of material with the segments captured therebetween.

11. The composite according to claim 1 wherein the first layer of material is at least substantially imperforate.

12. The composite according to claim 1 wherein the segments are oriented to within about 6° of the expected load lines.

13. The composite according to claim 1 wherein the segments comprise fibers.

14. The composite according to claim 13 wherein the fibers comprise laterally dispersed fibers.

15. The composite according to claim 14 wherein the laterally dispersed fibers comprise generally single-layer fibers.

16. The composite according to claim 1 wherein said segments comprise yarns.

17. The composite according to claim 16 wherein said yarns comprise multiple fiber yarns.

18. The composite according to claim 17 wherein the multiple fiber yarns comprise untwisted fibers.

19. The composite according to claim 1 wherein the segments comprise mats of stretch-resistant mat elements, at least most of the mat elements in each mat being generally parallel.

20. The composite according to claim 19 wherein the mat elements are oriented at angles of from about 0 °to 3° relative to one another.

21. The composite according to claim 19 wherein the mat elements are oriented at angles of from about 0 °to 6° relative to one another.

22. The composite according to claim 19 wherein said mat elements comprise laterally spaced-apart mat elements.

23. The composite according to claim 19 wherein the mat elements of at least one of the mats are of generally equal length.

24. The composite according to claim 23 wherein the mat elements of the at least one of the mats have ends which are generally aligned with one another.

25. The composite according to claim 1 wherein the segments comprise segment ends, said segment ends being laterally-staggered.

26. The composite according to claim 1 wherein the sheet of material is in the form of a sail having a plurality of corners with expected load lines extending from the corners.

27. The composite according to claim 26 wherein the at least one section is a flat, two-dimensional section.

28. The composite according to claim 26 wherein the at least one section is a three-dimensional section.

29. The composite according to claim 1 wherein at least some of the segments are mounted to a flexible central strand to form a belt of segments extending generally perpendicular to said central strand.

30. A low-stretch, flexible composite comprising:

a sheet of material; and the sheet comprising a section, the section comprising:

a first layer of material;

a plurality of discontinuous, stretch-resistant segments adhering to the first layer of material; and said segments having segment ends, at least most of said segment ends being laterally-staggered.

31. The composite according to claim 30 further comprising:

a second layer of material adhered to the first layer of material with the segments captured therebetween; and wherein:

the segments comprise mats of stretch-resistant mat elements, at least most of the mat elements in each mat being generally parallel.

32. The composite according to claim 31 wherein:

the sheet comprises expected load lines extending over the section when the sheet is to be used as an air foil of a sailcraft sail under a chosen loading;

the mat elements extend generally along the expected load lines within the section; and the mat elements comprise mat fibers, said mat fibers of each said mat element oriented over a range of angles from about 0° to 6° relative to the orientation of said mat element.

33. A low-stretch, flexible composite comprising:

a sheet of material; and the sheet comprising at least one section having expected load lines extending over the section, each section comprising:

a first layer of material;

a plurality of discontinuous, stretch-resistant segments adhering to the first layer of material and extending generally along the expected load lines, a majority of the segments having lengths substantially shorter than corresponding lengths of the expected load lines within the section; and at least a majority of the mat elements cross other mat elements.

34. A low-stretch, flexible composite comprising:

a sheet of material; and the sheet comprising at least one section having expected load lines extending over the section, each section comprising:

a first layer of material;

a plurality of discontinuous, stretch-resistant segments adhering to the first layer of material and extending generally along the expected load lines, a majority of the segments having lengths substantially shorter than corresponding lengths of the expected load lines within the section; and said mat elements comprising a layer of laterally-arranged mat elements.

35. The composite according to claim 34 wherein the laterally-arranged mat elements comprise laterally-arranged mat fibers.

36. The composite according to claim 35 wherein the mat fibers of each mat are oriented relative to one another over a range of angles from about 0° to 6° so that at least a majority of the mat fibers cross other mat fibers.

37. A low-stretch, flexible composite comprising:

a sheet of material; and the sheet comprising at least one section having expected load lines extending over the section, each section comprising:

a first layer of material;

a plurality of discontinuous, stretch-resistant segments adhering to the first layer of material and extending generally along the expected load lines, a majority of the segments having lengths substantially shorter than corresponding lengths of the expected load lines within the section; and at least some of the mats comprising cross-elements extending transverse to the generally parallel mat elements.

38. The composite according to claim 37 wherein said mat elements comprise:

laterally spaced-apart mat elements; and a layer of laterally-arranged mat elements.

39. The composite according to claim 38 wherein said laterally spaced-apart mat elements comprise multi-fiber yarns and the layer of laterally-arranged mat elements comprise a layer of laterally-arranged fibers which are generally parallel and in contact with adjacent fibers.

40. A low-stretch, flexible composite comprising:

a sheet of material; and the sheet comprising at least one section having expected load lines extending over the section, each section comprising:

a first layer of material;

a plurality of discontinuous, stretch-resistant segments adhering to the first layer of material and extending generally along the expected load lines, a majority of the segments having lengths substantially shorter than corresponding lengths of the expected load lines within the section; and at least some of the mats overlap an adjacent mat.

* * * * *